US005722898A

United States Patent [19]

Witten

[11] Patent Number: 5,722,898

[45] **Date of Patent: *Mar. 3, 1998**

[54] POINTER ROD GOLF CLUB SWING TRAINER

[76] Inventor: William C. Witten, 3532 Golden Crest La., Rosamond, Calif. 93560

[21] Appl. No.: 725,945

[22] Filed: Sep. 11, 1996

Related U.S. Application Data

[60] Provisional application No. 60/014,767 Apr. 3, 1996.

[51] Int. Cl.[6] ..... A63B 69/36

[52] U.S. Cl. ..... 473/211; 273/DIG. 17

[58] Field of Search ..... 473/210, 208, 473/209, 211; 273/17

[56] References Cited

U.S. PATENT DOCUMENTS 4,079,940 3/1978 Arakaki ..... 473/210

5,165,683 11/1992 Beutler et al. ..... 273/35 R 5,171,152 12/1992 McCleery ..... 434/252

*Primary Examiner*—George J. Marlo

*Attorney, Agent, or Firm*—Dennis W. Beech

[57] ABSTRACT

The pointer rod is a rod having a tip and an attachment end to be attached to a user's cap visor or other head attachment device. The attachment end may have a clip such that the pointer rod may be slipped onto the visor and retained by the spring force of the clip. The rod may be constructed of rod elements which may be collapsed one into the other thus allowing for a variable length pointer rod and for ease of storage. By proper location of the pointer rod relative to the user's focal center line of sight when the user's head moves the movement is exaggerated to aid in catching a golfer's attention to aid in training to watch a golf ball while moving a golf club.

1 Claim, 1 Drawing Sheet

POINTER ROD GOLF CLUB SWING TRAINER

CROSS REFERENCES TO RELATED APPLICATION

This is a patent application of provisional patent application Ser. No. 60/014,767 filed on Apr. 03, 1996.

BACKGROUND OF THE INVENTION

1. FIELD OF THE INVENTION

This invention relates to devices used to train or practice swinging a golf club for the game of golf. The new device provides a simple means for golfers to practice keeping their eyes on the ball during their swing of the golf club.

2. DESCRIPTION OF RELATED ART

There are currently known various devices for users to use in training to keep their eyes on a golf ball to be hit. In teaching to properly swing a golf club to hit a golf ball, the emphasis is normally for golfers to keep their eyes on the ball as the hips, shoulders and arms move relative to the back swing, down swing and follow through of the movement of the golf club. This trains the golfer's head to generally remain fixed to watch the ball rather than the natural tendency to follow the body movements and the golf club.

When golfers wear a hat with a visor or bill, devices may be attached to the visor to aid in training to keep the user's eyes on the golf ball. Examples of currently known devices include attaching a cross hair device or a frame device similar to eye glasses at the end of the visor. This places an attention catching device relatively close to the user's eyes in the line of sight on which the user should concentrate to swing the golf club to hit the ball. Another example is a small laser device attached to the visor. In this case when the laser is activated a spot of light is projected in front of the user at the object in the direction in which the head is turned. If the golfer is looking at the golf ball the spot of light should be on the ball. Again this is an attention catching device. However, if the user has looked away from the ball and is not looking at a light reflecting surface, the laser light would not be visible. Such a circumstance would arise if golfers were to turn their head upward in the direction of the sky thus defeating the attention gathering objective.

The present invention provides a simple device to catch the attention of the user by placement of a physical object in the line of sight of the eyes. The pointer rod may be attached to the visor of a cap so that when the golfer looks at the golf ball the pointer rod, including any tip, points toward the golf ball just above the optical center line of sight. When users move their head, the visor of the cap moves accordingly and the movement is exaggerated by the length of the pointer rod thus serving as a reminder to the golfer to fix the head and eyes on the ball.

SUMMARY OF THE INVENTION

A primary objective of the present invention is to provide a means to remind golfers to keep their eyes on the golf ball when swinging the golf club. Another object is to exaggerate any head movement which normally is caused by eye movement to catch the attention of the golfer to such movement. A further object of an embodiment is to provide a pointer rod which may be easily stored when not in use.

In accordance with the description presented herein, other objectives of this invention will become apparent when the description and drawings are reviewed.

DESCRIPTION OF THE PREFERRED EMBODIMENT

The pointer rod consists of a rod having a tip end and a means to attach the rod to a golfer's head above the users line of sight. The pointer rod may be of fixed length or variable length by means of a collapsible rod. A preferred method of attachment to the users head is to attach the pointer rod to the visor of a hat or cap worn by the golfer.

Figure 1:
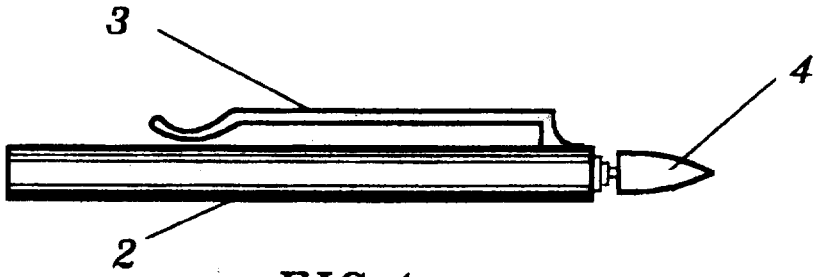
FIG. 1 illustrates a side view of the pointer rod in the collapsed configuration.
Figure 2:
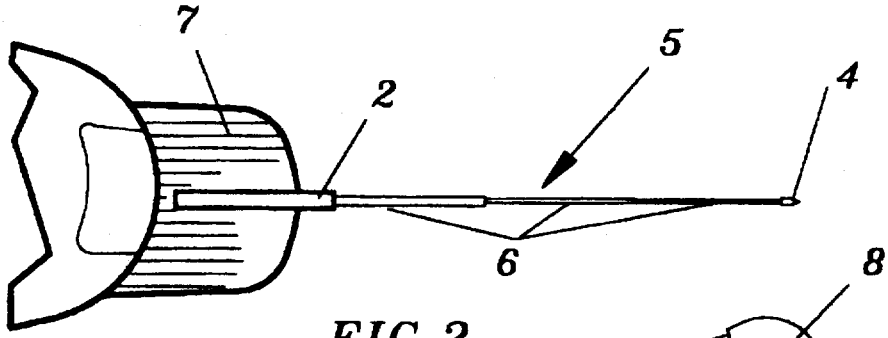
FIG. 2 illustrates a top plan view of the pointer rod attached to a cap visor with the pointer rod extended.
Figure 3:
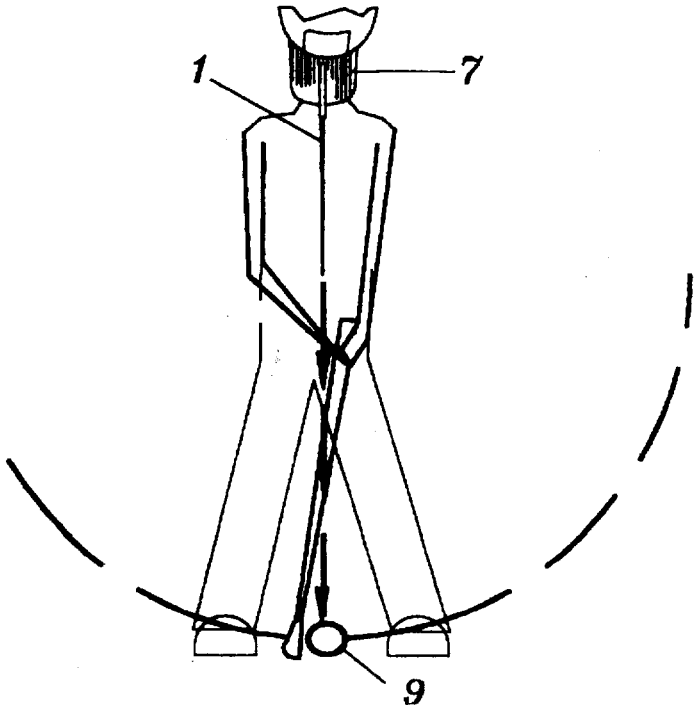
FIG. 3 illustrates a front elevation view of a golfer with head bent forward to observe the golf ball and pointer rod pointing at the ball.
Figure 4:
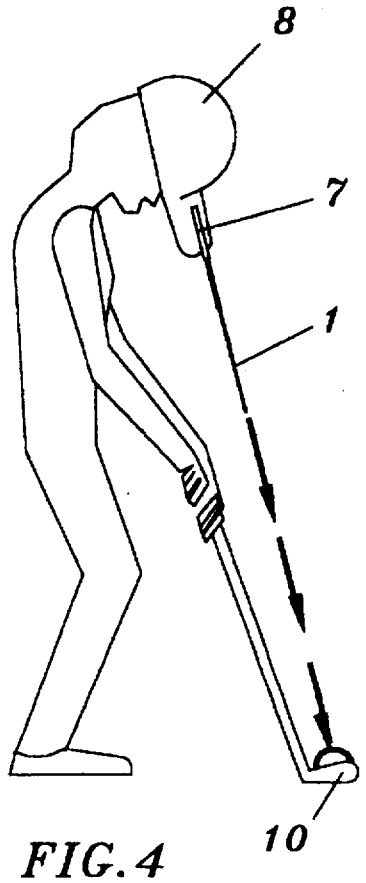
FIG. 4 illustrates a side elevation view of a golfer with head bent forward to observe the golf ball and pointer rod pointing at the ball.

Referring to FIGS. 1 through 4, the pointer rod (1) has an attachment end (2) with clip (3) and a tip end (4). In the preferred embodiment the rod (5) is comprised of rod elements (6) with appropriate relative diameters to allow collapsing of the rod (5) to provide shorter lengths or for storage. Obviously the rod (5) may be formed of a single rod element (6) of a fixed length.

The attachment end (2) and clip (3) are slid onto the visor (7) of cap (8) and retained by the spring tension of the clip (3). With the cap (8) properly placed on a users head and the pointer rod (1) extended the pointer rod (1) is located just above the optical line of sight of the golfer's eyes. The rod (5) with tip end (4) points toward the same position as the user looks when the eyes optical center is perpendicular to the plane of the face.

If the head of the user moves in a reaction to the movement of the eyes, the cap (8) is moved thus moving the pointer rod (1) to exaggerate the motion to catch the attention of the user. The motion is exaggerated because the pointer rod (1) extended is long enough such that any head motion is obvious to the user. This provides the training aid to develop golfers concentration to keep their head and eyes on the golf ball (9) while swinging a golf club (10).

The pointer rod (1) may be permanently attached to a visor (7) by sewing, straps or other suitable means. The tip end (4) may be enlarged in size or brightly colored to further aid in catching the user's attention.

I claim:

1. A pointer rod for attachment on a user's hat comprising:

a rod having a tip end and comprised of a plurality of rod elements which fit successively one into the other to allow extension and collapsing of the rod relative to an attachment end;

a clip attached to the attachment end oriented to be clipped on a user's hat visor; and the rod elements being of sufficient number and relative length such that when the attachment end is attached to the user's hat visor and the user's eyes are viewing a golf ball the rod is located above the optical line of sight of the user's eyes and, when the head of the user moves, the corresponding movement of the tip end of the pointer rod is significantly exaggerated because of the extended length of the pointer rod which permits its detection by the user and provides a reminder to the user to fix the head and eyes on the golf ball.

* * * * *